United States Patent [19]

Neely

[11] 3,995,335

[45] Dec. 7, 1976

[54] PILLOW FOR INVALIDS

[76] Inventor: Elizabeth E. Neely, 34 Highland Drive, N.E., Atlanta, Ga. 30305

[22] Filed: Feb. 10, 1976

[21] Appl. No.: 656,899

[52] U.S. Cl. ..... 5/327 B; 5/338; 297/284; 297/377

[51] Int. Cl.[2] ..... A47C 21/00; A47G 9/00

[58] Field of Search ..... 297/284, 377, 456; 5/327 R, 327 B, 338

[56] References Cited

UNITED STATES PATENTS

| | | | |
|---|---|---|---|
| 1,063,423 | 6/1913 | Edelin | 5/327 B |
| 3,293,669 | 12/1966 | Emery | 5/327 R |
| 3,329,979 | 7/1967 | Drapin | 5/327 R |
| 3,680,917 | 1/1972 | Harris | 297/456 |
| 3,822,424 | 7/1974 | Messer | 5/327 B |

*Primary Examiner*—Casmir A. Nunberg
*Attorney, Agent, or Firm*—James B. Middleton

[57] ABSTRACT

A pillow apparatus for supporting a person in bed in a generally sitting position, the apparatus including a generally rigid frame, a plurality of pillow sections attachable to the frame so that the pillow sections are stacked one upon another and are so held by the frame, and a bumper extends forwardly from the frame to be engaged by the buttocks to prevent a person's sliding down from the desired position.

6 Claims, 4 Drawing Figures

Fig. 1
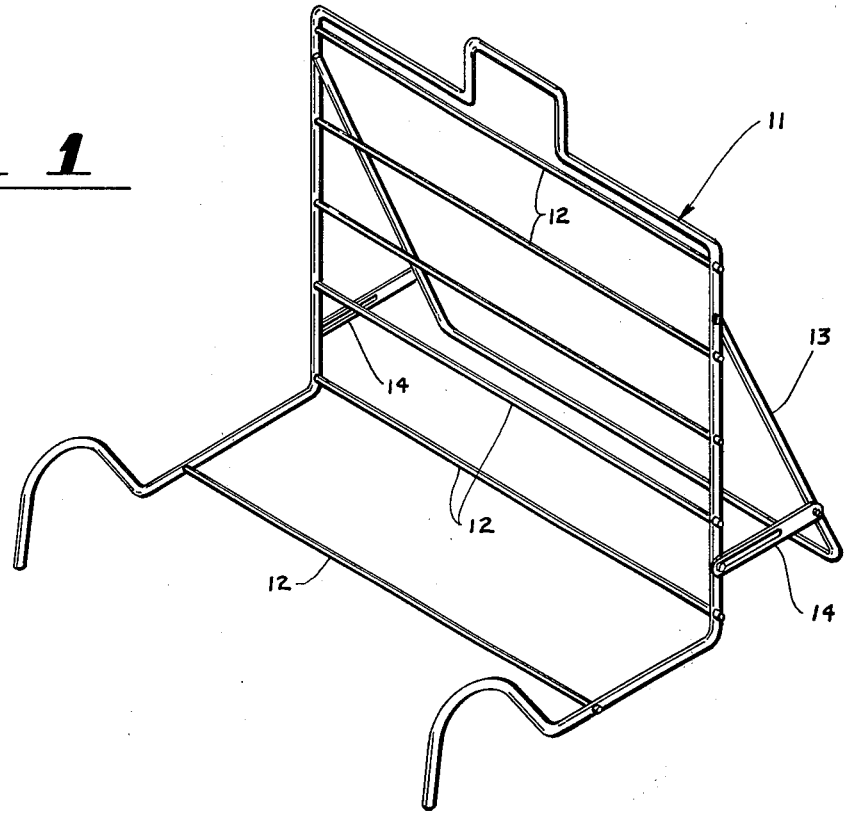
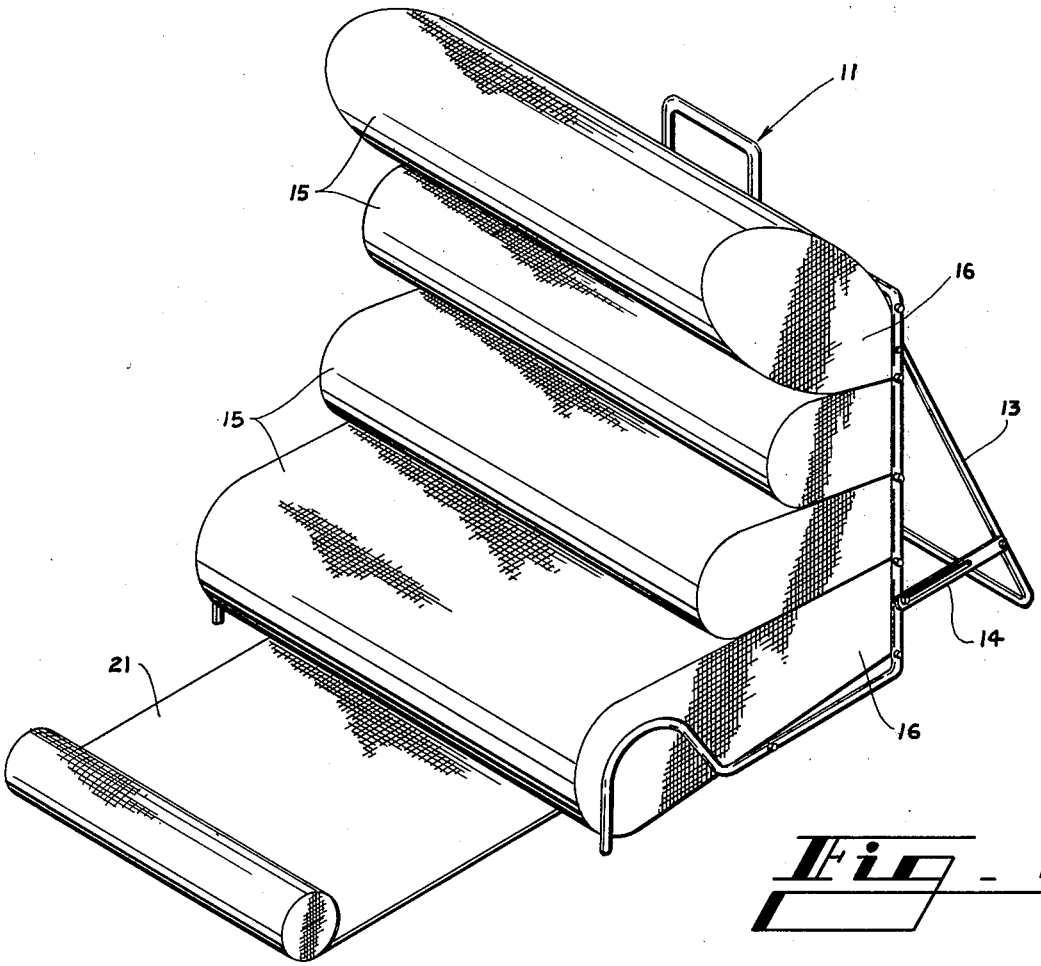
Fig. 2

PILLOW FOR INVALIDS

This invention relates to improvements in pillows, and especially of the type that are used for the comfort of persons confined to the bed and also of persons who enjoy reading in bed. So it is an object of this invention to devise a pillow arrangement that permits easy adjustment to the comfort of the person using this pillow. Another object is to devise such a pillow that is light enough that it can be conveniently moved from place to place. And another object is to devise a way to prevent the filling from packing down to the bottom as would happen if the pillow were not in sections, and another object is to devise an attachment to the basic frame so that the person using the pillow does not keep slipping down but remains in the desired position which gives the greatest comfort.

These objects can be obtained by a pillow made in sections that are held in place by being attached to a basic frame and also by allowing the filling of each section to be adjusted to the comfort of the user and also to have a bumper against which the buttocks rests.

The best embodiment of my invention, now known to me, has been illustrated in the accompanying drawings, but it is understood that these embodiments have been chosen solely for the purpose of illustration, so they are not to be taken as limiting, for obviously, changes can be made so long as they fall within the ambit of the appended claim.

In the following drawings

FIG. 1 is a view of the basic frame.

FIG. 2 is a view of the front showing the pillow in place on the frame.

Figure 3:
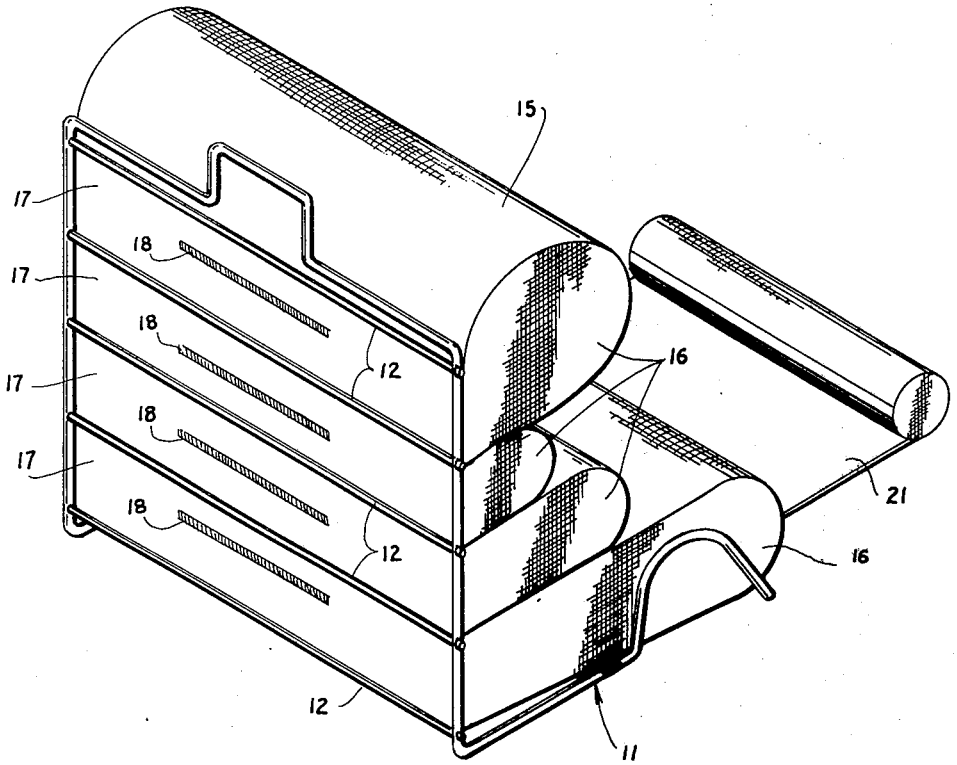
FIG. 3 is a view of the back of the pillow and frame.

FIG. 1 is the assembly of the frame which supports the pillow. 11 is the basic structure. It should be made of strong light-weight material such as aluminum tubing, bent-wood, etc. The bend at the top is the handle which makes it easy to move the entire pillow. Holes are made in each upright part — exactly opposite — and in the base part — exactly opposite — of the diameter to allow rods 12 to pass through and be in a horizontal position. The front of the base of II is raised in a deep curve so that the lower section of the pillow is kept in position. As many sets of holes should be in the upright part as there are sections of the pillow, but only one set in the base is necessary for attaching the bumper 21. Also a set of holes are to be near the top of the upright so that 13 may be attached, and a set of holes near the bottom of the upright for attaching 14. The under part of base which sits on the bed or other surface, should be treated to be non-skid. The ends of the curve of the base should have non-skid tips which can be rubber, plastic, etc. 12 is a small rod of strong material, for it will bear the weight of the strain put on the pillow, one end of which has a fixed knob, of any design, although shown in the drawings as round, and the other end threaded so that a similar knob can be screwed on after the pillow is in place. 13 is in the shape of three sides of a rectangle with rounded corners and to be of the same material as II. A set of holes is to be near the top so that it may be attached to II; and a set of holes near the base for attaching 14 to keep it in place. The under part of the base is to be treated for non-skid and the ends are to be capped if necessary to cover raw edges. Neither 13 or 14 need be used if the base of the structure is to be braced against a headboard or other flat support. In that case, 13 and 14 should be detached. 14 is a flat piece of metal with a length-wise slot and should be long enough that when attached to II and 13 that II is in an upright position.

FIG. 2 shows the front view of the assembly of the pillow with the basic frame. 15 and 16 are to be made of a sturdy fabric such as a heavy upholstery material. If ticking is used a slip cover can be made with a slit in the top to allow the handle of II to come through. 15 and 16 are sewn to the back 17 (as shown in FIG. 3) with two rows of stitching at each section to form a case or pocket for 12 to pass through to hold the pillow in place. 15 is the front of the pillow and 16 is the side or ends of each section. Both are shaped to conform to the greatest comfort of the user. The drawing shows four sections but it can be in as many or as few sections as desired. The filling can be of any soft material, such as Kapok, sponge rubber, feathers, etc. The top section is more rounded and projects farther so that the person's head is forward. 21 is a bumper against which the bottocks rests to prevent the individual from slipping down. It has a rounded pillow on one end and the flat part is double thickness with several pockets sewn near the end through which 12 passes to attach it to the base of the frame assembly, thereby it's length can be adjusted to the comfort of the individual. It is, of course detachable if not needed.

FIG. 3 shows the back view of the assembly of the pillow with the basic frame without brace 13 and 14. The important feature shown here is the zipper 18 which is placed in each section of 17. This allows one to add more filling if a section is too limp, or to take out some of the filling if a section is too packed, thus allowing each section to be fitted to the user's comfort. Should air be used for the filling a valve should be used instead of the zipper.

Figure 4:
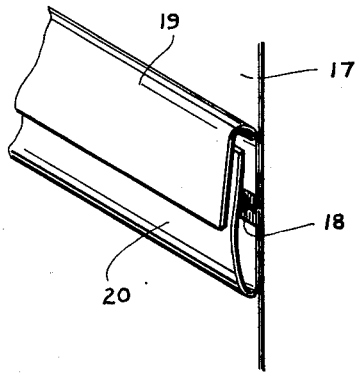
FIG. 4 shows a means of preventing the filling from interfering with the working of the zipper.

FIG. 4 is a cross section, in exaggerated form, to show flaps 19 and 20 on the inside of each section of the back 17. These flaps hold the filling away from the zipper 18 so that it is free from the filling which might otherwise interfere with it's operation.

I claim:

1. A pillow apparatus for supporting a person in bed in a generally sitting position, said pillow apparatus comprising a frame including an upright portion, a plurality of pillow sections, means for removably fixing said plurality of pillow sections to said upright portion of said frame in superposed relation to one another, and a bumper fixed to said frame and extending forwardly thereof, said bumper including a bumper pillow disposable generally against the buttocks of said person.

2. A pillow apparatus as claimed in claim 1, said frame further including a pair of front curved portions, one of said front curved portions being disposed on each side of the lowermost pillow section of said plurality of pillow sections.

3. A pillow apparatus as claimed in claim 2, each of said pillow sections having filling therein, and each of said pillow sections including a closing device for selectively closing an opening in said pillow sections, and flap means internally of said pillow sections and covering said closing device to prevent interference of said filling with said closing device.

4. A pillow apparatus as claimed in claim 2, said frame including a brace pivotally fixed to said upright portion, and an adjusting member extending from said upright portion to said brace, said brace and said adjusting member being so constructed, and arranged that said brace will support said upright member in a generally vertical position and said adjusting member will fix said brace in the desired position.

5. A pillow apparatus as claimed in claim 4, said upright portion of said frame including handle means formed integrally therewith, said frame being substantially rigid for allowing transport of said pillow apparatus by said handle means.

6. A pillow apparatus as claimed in claim 3, one of said plurality of pillow sections being the uppermost pillow section, said uppermost pillow section being so sized as to extend forwardly beyond the adjacent pillow section for urging said person's head forwardly.

* * * * *